United States Patent [19]

Bressan et al.

[11] Patent Number: 4,781,047

[45] **Date of Patent: * Nov. 1, 1988**

[54] CONTROLLED SPIN FLOW FORMING

[75] Inventors: Renato J. Bressan, Forked River, N.J.; Andrew Halasz, Crystal Lake, Ill.; Lawrence S. Maccherone, Severna Park, Md.; Eugen F. Ihly, Denver, Colo.

[73] Assignee: Ball Corporation, Muncie, Ind.

[ * ] Notice: The portion of the term of this patent subsequent to Jan. 14, 2003 has been disclaimed.

[21] Appl. No.: 858,774

[22] Filed: May 2, 1986

Related U.S. Application Data

[63] Continuation-in-part of Ser. No. 758,394, Jul. 24, 1985, abandoned, which is a continuation-in-part of Ser. No. 542,309, Oct. 14, 1983, Pat. No. 4,563,887.

[51] Int. Cl.[4] ..... B21D 17/04

[52] U.S. Cl. ..... 72/84; 72/105

[58] Field of Search ..... 72/84, 94, 105, 106; 220/67, 74, DIG. 22

[56] References Cited

U.S. PATENT DOCUMENTS

| | | | |
|---|---|---|---|
| B 223,678 | 3/1976 | Nixon et al. . | |
| 1,939,577 | 12/1933 | Sneed . | |
| 2,312,225 | 2/1943 | Wilkinson . | |
| 2,353,349 | 7/1944 | Merolle . | |
| 3,469,428 | 9/1969 | Aschberger . | |
| 3,688,538 | 9/1972 | Hoyne . | |
| 3,763,807 | 10/1973 | Hilgenbrink . | |
| 3,782,314 | 1/1974 | Franek et al. . | |
| 3,874,209 | 4/1975 | Maiorino . | |
| 3,913,336 | 10/1975 | Nelsen et al. . | |
| 3,913,366 | 10/1975 | Nelsen et al. . | |
| 3,962,896 | 6/1976 | Bichel . | |
| 3,994,251 | 11/1976 | Hake et al. . | |
| 4,018,176 | 4/1977 | Gynp et al. . | |
| 4,030,432 | 6/1977 | Miller et al. . | |
| 4,070,888 | 1/1978 | Gombas . | |
| 4,144,732 | 3/1979 | Franks et al. . | |
| 4,341,103 | 7/1982 | Escallon et al. | 72/105 |
| 4,487,048 | 12/1984 | Frei . | |
| 4,512,172 | 4/1985 | Abbott et al. | 72/84 |
| 4,563,887 | 1/1986 | Bressan et al. | 72/84 |

FOREIGN PATENT DOCUMENTS

| | | |
|---|---|---|
| 477348 | 10/1974 | Australia . |
| 0075068 | 3/1983 | European Pat. Off. . |
| 0140469 | 5/1985 | European Pat. Off. . |
| 2345871 | 1/1973 | Fed. Rep. of Germany . |
| 2703141 | 7/1977 | Fed. Rep. of Germany . |
| 2805321 | 8/1978 | Fed. Rep. of Germany . |
| 1512772 | 6/1978 | United Kingdom . |

*Primary Examiner*—Lowell A. Larson

*Attorney, Agent, or Firm*—Sheridan, Ross & McIntosh

[57] ABSTRACT

A system and apparatus for roll forming to neck-in D&I can ends and replace double necks and triple necks is disclosed. An externally disposed free roll having independently rotatable sections is moved inward and axially against the outside wall of the open end of a rotating trimmed can to form a conical neck at the open end of the cap, the two sections of the roller having different speeds depending upon neck diameters respectively engaged thereby. A spring loaded interior support roller moves under the forming force of the free roll. This is a single operation where the can rotates and the free roll rotates such that a smooth conical necked end and flange are produced.

14 Claims, 3 Drawing Sheets

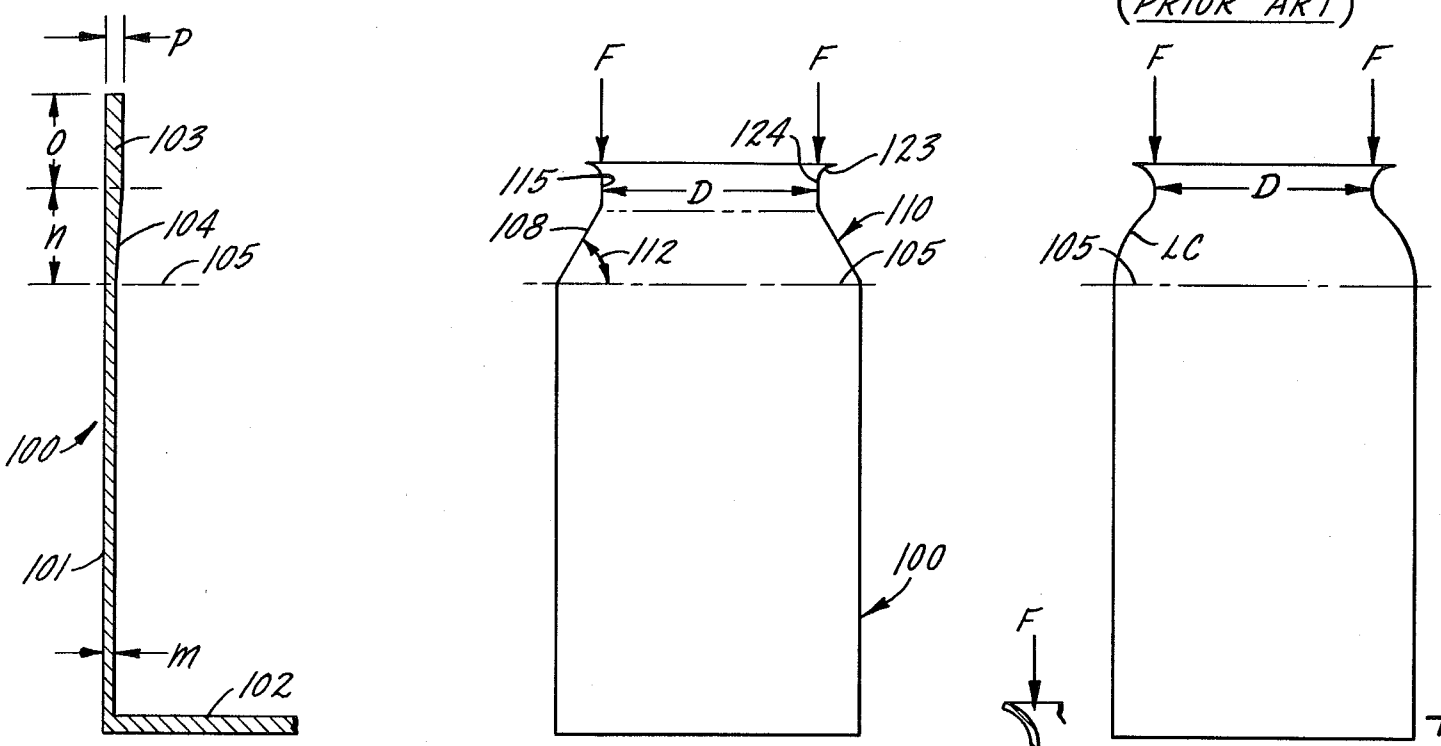
FIG. 3A.
FIG. 3B.
FIG. 3C. (PRIOR ART)
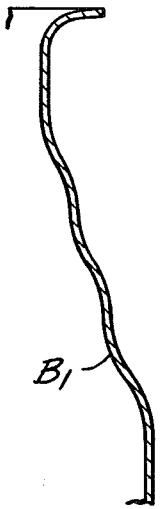
FIG. 3D. (PRIOR ART)
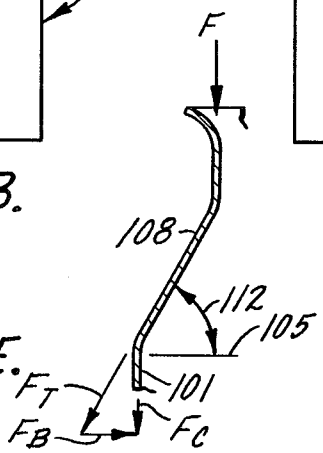
FIG. 3E.

CONTROLLED SPIN FLOW FORMING

CROSS-REFERENCE TO RELATED APPLICATIONS

This application is a continuation-in-part of Ser. No. 758,394, filed July 24, 1985, now abandoned, which in turn is a continuation-in-part of Ser. No. 542,309, filed Oct. 14, 1983, now U.S. Pat. No. 4,563,887, issued Jan. 14, 1986.

BACKGROUND OF THE INVENTION

This invention relates to containers; the body for such containers being in the form of cylindrical one-piece metal can having an open end terminating in an outwardly directed peripheral flange merging with a circumferentially-extending neck portion (the can body being hereinafter referred to as a D&I can). Methods of forming said neck and flange in a D&I can body and to apparatus for forming the said peripheral flange and neck portion.

The background for this disclosure relates to the way in which D&I can bodies are manufactured in drawing and then multiple ironing operations. For 20 years beverage containers have been made by a drawing and then multiple ironing processes in which the metal material is first drawn into a cup to establish the shape and a basic inside diameter and the cup is then pushed through a series of ironing rings which merely thin the side wall and do not appreciably affect the diameter.

The cross-sectional configuration of the ironing ring includes a chamfer, a land and finally a relief angle. The ironing process begins on the chamfer and is completed by the land during which time no drawing takes place. The process is done at high speed under a coolant/lubricant flood in order to accommodate the severity of the operation especially the heat. These containers have to be washed and in some cases chemically treated to remove residual lubricant and improve corrosion performance of organic coatings and decoration subsequently applied to the container. Coatings are normally applied after the shell has been trimmed and washed free of lubricants and metal fines.

The ironing steps result from the difference between the clearance between a punch and ironing ring land and the thickness of the metal sidewall. That clearance represents the amount to which the side wall of the container will be thinned. Usually, metal with no organic coating passes through three different ironing rings in a D&I operation during which ETP electrolytic of T-1 to T-5 temper tinplate or H19 aluminum container sidewall is reduced about 25% in the first pass, about 25% of its new thickness in the second pass, and about 40% of its new thickness in the last pass, while the metal and tooling are flooded with lubricant coolant.

This operation increases the side wall length to several times that of the cup which was formed in an ordinary and separate one or two-draw operation. The cleaned and trimmed D&I can may then be necked and flanged in a separate apparatus and an independent operation. The grain orientation of the ironed sidewall is highly directional and the D&I can is subject to longitudinal cracking particularly at the radially extending flange. The purpose of the peripheral flange is usually to provide an element to which a can end is secured after the can has been filled, this securing being done by deforming the end flange of the can body together with a peripheral cover hook of the can end so as to form a double seam. Consequently, flange cracks are a problem to achieving a hermetic double seam. The neck enables the flange, and therefore the can end, to be of smaller diameter than if there were no neck; usually the radial depth of the neck is such that the double seam has an external diameter less than that of the cylindrical side wall. Necking also minimizes the radial extent of the flange thus helping to resist flange cracking.

In some types of metal lids, such as those having easily opened ends of the so-called "ring pull" or "tab" type, the end to be seamed on to the flange of the can body is preformed with the scored opening feature. These opening features often determine the diameter of the end and only recently has the tab-type been reduced in size to permit ends as small as 202 being 2 and 2/16" across the double seam (can makers conventional terminology).

The end neck may serve another purpose, which is to provide a convenient means whereby a carrier can engage the container; such carriers are designed to hold a plurality of containers and may be of, for example, paperboard or a flexible plastic material. The type of carrier which engages the neck of a container of the kind with which this disclosure is concerned may include a horizontal web in which there are a plurality of holes, the periphery of each hole engaging below the above-mentioned container double end seam so as to support the container wholly or partly thereby. Where the container body is necked, the neck can be so shaped as to provide some measure of support and/or restraint for the carrier web around the hole in the latter, and to assist in locking the container to the web until the user wishes to pull it away from the carrier. Similarly, a reduced neck allows the cans to be held in close parallel relation thus, minimizing the total space needed to hold the containers. In addition, the necked end can can be designed to stack against the bottom of a similar container for ease of shipping.

Various method have been used and proposed for forming an end neck and flange on a one-piece can body. Some methods involve molding the neck and/or the flange by means of circumferentially extending molds. Die necking has also been used to longitudinally move a die against the end of a supported D&I can to force same to a smaller diameter by means of the application of the die. Other methods involve rolling or spinning the neck and/or flange, using an external spinning roll of a given shape co-operating with an internal member of a companion shape within the can body. In these latter methods, the can body is supported rigidly by an internal mandrel or the like; the internal member may be a spinning roll, pilot or it may be the mandrel which supports the can body. In one such method the neck and flange are formed simultaneously in a can body supported internally and rigidly by a mandrel or chuck of an expanding/collapsing type, the neck and flange profile being formed by external spinning rolls co-operating with this mandrel.

In another method, the can body is supported internally by an anvil and endwise by a spinning pilot, the neck and flange being formed by a profiled, external spinning roll which deforms the can body into a groove formed on the pilot and anvil, the roll being moved axially of the can body.

In all these previously-proposed methods the final profile of the neck and flange is determined by the set profiles of the tool elements used for forming them, in that the tool elements (i.e., spinning rolls, mandrels, anvil etc.) are provided rigidly with fix working surfaces shaped to conform with the ultimate shape of the neck and/or the flange, and the metal of the can body is deformed into conformity with these profiles. It is thus necessary, if a different shape is required to change the tools so as to provide differently profiled tool elements.

A method such as that mentioned above, in which an expanding mandrel is used enables end flanges and neck portions to be produced reliably and economically even on can bodies made in the thinner and harder metals currently in favor, in particular double-reduced plate which is usually tinplate, but which may, for example, be aluminum, mild steel or blackplate suitably treated but not necessarily plated with another metal. The present invention is also especially suitable for use with these thinner and harder double reduced or work hardened materials.

The problems with the rolling or spin forming of tooling used in the prior art concerns the weak and relatively unsupported upper sidewall metal of the open end of a D&I can body. Such metal is usually very thin around 0.004" to 0.006", highly worked during ironing and highly grain oriented. Merely placing a tool with the desired profile inside the container and applying a similarly shaped roller to the outside of the container while same is spun does not give the metal during the forming operation adequate or complete support to prevent wrinkling, cracking, buckling, crushing or tearing. This uncontrolled or unsupported application of radial side force on the thin metal sidewall of the open end is unacceptable particularly in connection with the higher temper (H19, T5 or double reduced) materials in connection with operations performed at high speeds wherein the rate of production of the containers during necking and flanging is more than several hundred per minute. No known method for providing adequate support or complete control of the metal during forming was known whereby the problems stated in connection with the forming of necked and flanged containers were overcome.

OBJECTS OF THE DISCLOSURE

It is an object of the disclosure to provide a holding mandrel and roller combination which cooperate to overcome the problems of metal damage during a necking and flanging operation by means of spin flow forming.

It is another object of the invention to disclose a holding mandrel which co-acts with the forming roller to provide continuous support for the metal being spin flow formed into the neck and flange for a thin wall D&I can.

It is still a further object of the invention to disclose a combination of forming roller and holding mandrel which produce a container having a unique, smooth, conical necked in portion extending from the full diameter of the sidewall into the root of the neck and outwardly therefrom to a terminating flange suitable for hermetic double seaming with a small diameter lid.

SUMMARY OF THE DISCLOSURE

Disclosed is a unique tool for flow spin forming the opened end of thin wall D&I cans, a method for using that tool and a unique container configuration easily obtainable at commercial speeds by application of that tool with that method.

BRIEF DESCRIPTION OF THE DRAWINGS

FIG. 3A is a fragmentary sectional view of a can body wall;

FIG. 3B is a diagrammatic side view of a necked container produced by the invention;

FIG. 3C is a diagrammatic side view of a prior art necked container;

FIG. 3D is an enlarged fragmentary sectional view of a prior art necked sidewall;

FIG. 3E is an enlarged fragmentary sectional view of the necked sideall of the invention; and, FIGS. 4A, 4B, 4C, 4D, and 4E are enlarged fragmentary sectional views of progressive steps in the spin flow forming operation.

DETAILED DESCRIPTION OF THE DISCLOSURE

Figure 1:
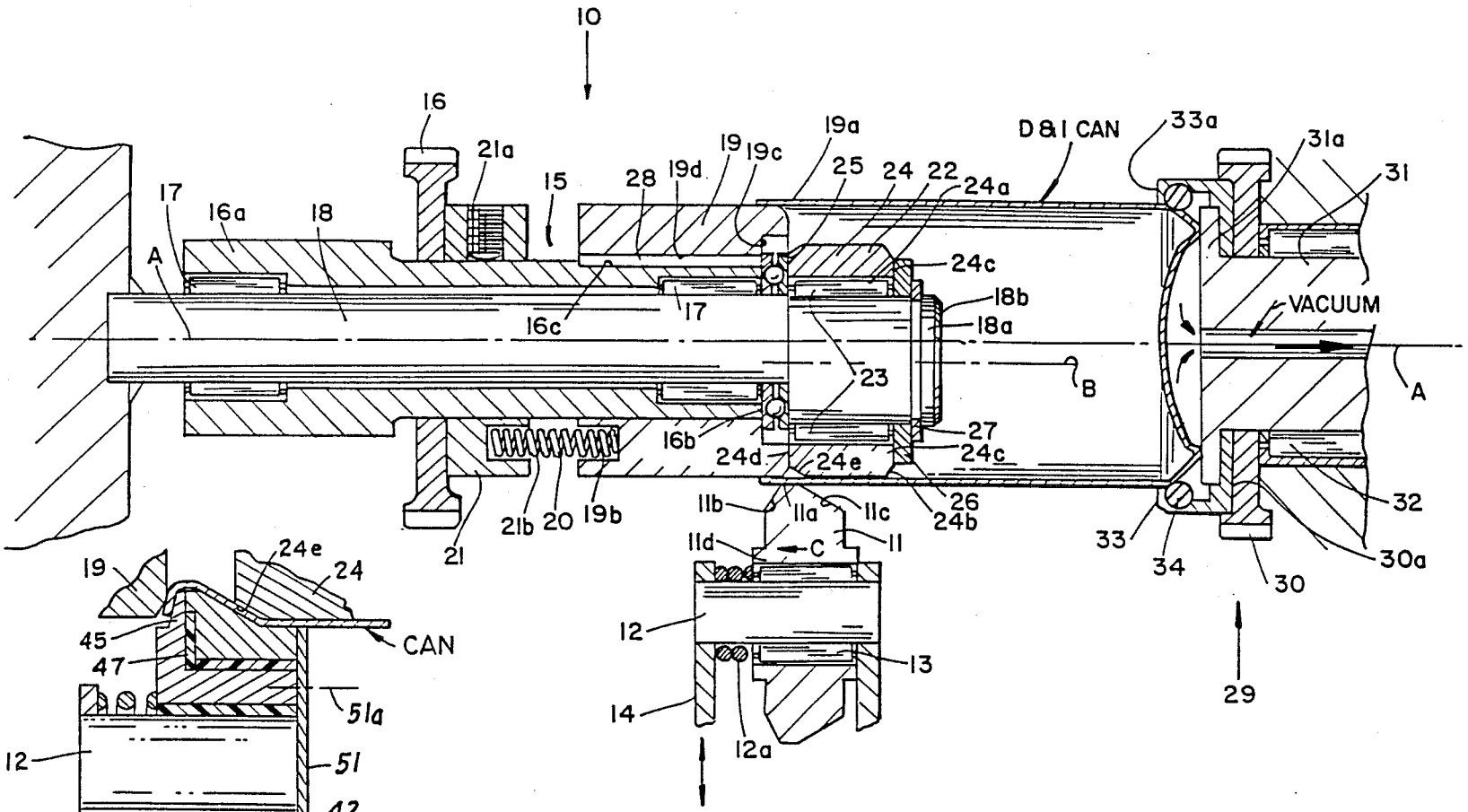
FIG. 1 is a side cross sectional view of a can necking and flanging tool made in accordance with the spirit of the present invention.

An apparatus 10 including a externally positioned roller 11 mounted on a mandrel 12, supported for full rotation by bearing 13 captured between the roller 11 and mandrel 12 to allow roller 11 to freely rotate with respect to its mounting yoke 14. The contour of the nose of periphery of roller 11, as shown in FIG. 1 includes flat **11*a*, a leading portion 11*b* and a trailing portion 11*c*. As can be seen in the Figure, the mandrel 12 has a greater axial length than the mounting hub 11*d* for the peripheral roller 11 whereby the roller 11 is free to slide, along the mandrel 12 against the urgings of a coil compression spring 12*a* which sets about mandrel 12 in reaction to axial thrust applied to the roller 11 during spin flow forming. The yoke 14 is mounted for controlled movement toward and away from the axis A of the apparatus 10** such as, for example, by a timed cam means.

The spinning device to drive the D&I can to be necked and flanged by spin flow forming is composed of a can support 15 which includes a gear drive 16 and its extended hub **16*a*, mounting bearings 17 within the extended ends of the hub 16*a*, which ride upon a fixed support shaft 18 and a D&I can end holder 19. The bearings 17 are disposed between shaft 18 and the hub 16*a* of gear 16. Shaft 18 is merely a fixed support and as such is not drivingly rotatable along its axis A. Holder 19 is shaped with a chamfered leading edge portion 19*a* designed to first engage the open end of a trimmed D&I can and then to support same for rotation about axis A in connection with the drive of gear 16 through the hub 16*a* therefore. Holder 19 is also free to slide axially relative to fixed shaft 18 but is resiliently biased into the open D&I can end by springs 20 (only one of which is shown in FIG. 1). The springs 20 are of the compression coil type and are captured in counter bored holes for controlled alignment and positioning. A driving collar 21 is mounted on hub 16*a* and arranged to rotate about shaft 18 in accordance with the drive from gear 16. More particularly, collar 21 has a set screw 21*a* to attach collar 21 to hub 16*a* and hold same adjacent gear 16 so that collar 21 is disposed with its counter bored holes 21*b* set to receive the springs 20 and locate same as to extend to holder 19. For that purpose, there is a cooperating counter bored hole 19*b* therein set to receive the other end of spring 20, shown in FIG. 1**, whereby holes 21*b* and 19*b* opposite lead portion 19*a* are opposite each other and aligned to carry spring 20.

Shaft 18 also carries a fixed inner roller assembly 22 which is mounted on an enlarged diameter (relative to the diameter of shaft 18) eccentrically disposed end 18*a* of shaft 18. More particularly, end 18*a* is cylindrical and offset to one side of the axis A such that it has a center line B. The offset is such that it is positioned at the center of the larger diameter of end 18*a* whereby the end 18*a* has one side which is in line with the side of shaft 18 and the other side which is offset relative thereto. Between the sides of end 18*a* and the roller assembly 22 there are bearings 23 which are a part of roller assembly 22 and support same for free rotation about axis B. The roller assembly 22 also includes a roller sleeve 24 having an inner diametrical surface 24*a* supported on bearings 23, an outer contoured surface 24*b* which is adapted to engage a part of the inside wall of the D&I can, a front face 24*c* and a rear face 24*d*. The latter is adapted to abut the portion 19*a* and more specifically, the face thereof when same is urged outwardly of collar 21.

Roller assembly 22 is restrained from axial movement relative to shaft end 18*a* by an inner axial bearing 25 disposed between the roller sleeve 24, rear face 24*d* and the holder 19. More particularly, holder 19 includes a recessed inner bore 19*c* which provides space for receiving the axial thrust bearing 25 and thereby limits the motion of holder 19 axially outwardly in response to the urgings of springs 20 whereby in its outwardmost position (holder 19 to the right in FIG. 1) abuts at 19*a* near face 24*d* of the sleeve but really against thrust bearing 25.

The outer end of sleeve 24 is maintained by means of a thrust bushing 26 in a form of a washer which during assembly is slid over end 18*a* and is held axially thereon by a retaining ring 27 disposed within a groove 18*b* circumscribed about the distal periphery of end 18*a*. Consequently, sleeve 24 is held in position between the bushing 26 and the bearing 25 so its axial location, relative to end 18*a* is fixed. Bearing 25 acts as a stop for the outward axial motion of holder 19 but the location of bearing 25 is defined by the hub 16*a* upon which gear 16 is carried. More specifically, the hub has bearings 17, as already mentioned, which ride on fixed shaft 18 and hub 16*a* extends to the right through attached collar 21 to its end 16*b* which abuts bearing 25 and carries bearing 17 inside that end. In a manner well known, hub 16*a* is free to rotate relative to shaft 18 but because of a keyed relationship between hub 16*a* and in particular a keyway 16*c* on hub 16*a* and 19*d* on holder 19 axial movement between holder 19 and hub 16*a* is permitted even though holder 19 rotates with hub 16*a*. In the keyway, defined by 16*c* and 19*d*, is a key 28 which acts like a spline to permit the axial motion of the holder 19 outwardly in response to the urgings of springs 20.

The D&I can is supported by its bottom which includes vacuum. This, of course, is not the only way in which the container may be held during its rotation along the axis A but FIG. 1 illustrates a convenient means by which the bottom of a container may be supported along a specific axis as it is rotated. More particularly, there is a chuck assembly 29 which includes a gear 30 driven at the same speed and in a manner similar to that used to drive gear 16. For example, by a jack shaft with pinions (not shown). Gear 30 has a center hub 31 which is provided with an axially positioned vacuum passage to permit vacuum to pass therethrough for purposes of holding the bottom of the D&I can. Hub 31 is supported cantilever on a bearing 32 whereby gear 30 can rotate when driven about axis A. A cup 33 is mounted to the face 30A of gear 30 and extends outwardly therefrom along axis A toward the bottom of the D&I can. Cup 33 is designed to carry an O-ring 34 within the inwardly (radial) rolled end thereof 33*a* in order to define a place against which the D&I can bottom can be sealed in order to maintain the vacuum established through the hub 31. More particularly, hub 31 has an extending flange 31*a* against which the bottom of the D&I can rests whereby the lower side wall is sealingly engaged with the O-ring 34.

In operation the yoke 14 carries peripheral roller 11 to engage the side wall of the open trimmed end of the D&I can betweenwhere same is supported by holder 19 and sleeve 24 while the D&I can is rotated between the hub 31 and the holder 19. The peripheral roller 11 is moved radially inward in response to controlled motion of yoke 14 and begins to define a conical necked-in end on the D&I can. More specifically, trailing portion 11*c* of roller 11 bears against the sidewall of the open end of the D&I can camming the roller 11 axially to the left in accordance with arrow C. For this purpose the end on sleeve 24 is chamfered at corner 24*e* and same cooperates with the trailing part 11*c* to define the angle of the conical neck for the D&I can. Any reasonable obtuse (with respect to the inside wall) angle is obtainable. The spin flow forming of the D&I can due to inward motion (radially) of roller 11 would be uncontrolled except for the fact that holder 19 is spring loaded axially outward (to the right) to engage the radially inwardly moving end of axially slidable roller 11. More specifically, the lead portion 11*b* of roller 11 comes into contact with portion 19*a* on holder 19 so that same will be urged under the spring force of coil springs 20 against the chamfer 24*e*.

It can now be appreciated that the force required to neck the end of the D&I can, can be maintained against the conically forming end by means of the cooperation between trailing part 11*c* and chamfer 24*e* both of which define the angle of the cone to be formed. The resistance to movement in the direction of arrow C of roller 11 by the contact between leading portion 11*b* and the portion 19*a* of holder 19 is essential. Throughout the forming of the conical end the motion radially inward of the yoke 14 which carries the roller 11 is similarly controlled. The axial motion in the direction of arrow C of the roller and the forming of the conical end between the roller 11 and the sleeve 24 are entirely controlled without any release of force against the container end during the spin flow forming.

The offset between axis A and axis B is provided in order to permit removal of the necked container notwithstanding the larger diameter of assembly 22. More particularly, the diameter to which the container is necked is still greater than the diameter of the assembly 22 whereby release of the conically necked D&I can from the chuck assembly 29 permits the container to tip relative to its axis A and slide over the outset of eccentric assembly 22.

Figure 2:
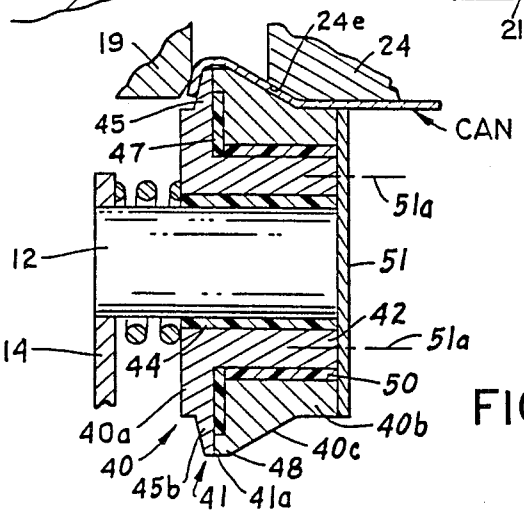
FIG. 2 is an enlarged sectional view of a modified roller assembly.

In FIG. 1 the roller 11 is a unitary or one-piece roller, applicable primarily for the deformation of steel containers or shells. FIG. 2 shows a modified version, a roller assembly 40, including a peripheral (split) nose portion 41 with a peripheral flat 41*a* intended to be opposed to aluminum container bodies for reasons to be explained.

The roller assembly 40 comprises two complemental roller sections 40*a* and 40*b*. In the form shown, roller section 40*a* includes a shank or sleeve 42 mounted for free rotation concentrically about the supporting mandrel 12 (described above), an antifriction bushing 44 of Teflon plastic or the like being interposed between the two.

Roller section 40*a* also includes a radial flange 45 having a leading portion 45*b*, the outer periphery of which presents a portion of the flat 41*a* as will be evident in FIG. 2.

The back of the flange 45 of roller section 40*a* is flat. Opposed thereto is the radial face of roller section 40*b*, undercut or recessed in part to receive an antifriction washer 47 such as Teflon plastic or the like.

The outermost periphery of roller section 40*b*, at 48, is flush with the outer periphery of roller 40*a* to complete the flat 41*a*. Rearwardly therefrom, the roller section 40*b* is tapered or sloped radially inwardly to define a trailing portion 40*c*, as in the instance of the unitary roller 11 of FIG. 1.

An antifriction bushing 50 is interposed between the outer diameter of the sleeve 42 and the inner diameter of roller section 40*b* so that the two roller sections may freely rotate relative to one another at different speeds.

The roller assembly is completed by disc 51 fitting flush against the radially aligned rear faces of the two roller sections. Disc 51 is bolted (at the dashed lines 51*a*, FIG. 2) to the sleeve portion of roller section 40*a*.

The leading portion 45*b* of roller section 40*a* performs the same function as the leading portion 11*b* of roller 11 described above. Trailing portion 40*c* of roller section 40*b* performs the same function as trailing portion 11*c* of roller 11 described above.

The roller assembly 40 is split compared to roller 11 and because of this the two roller sections can rotate independently at different speeds as an incident to engagement with the container being spun. This independent action of the two roller sections precludes wrinkles from occurring in the necked-in conical surface being formed at the open end of the container. Thus the wider roller section 40*b*, compared to roller section 40*a*, will rotate at a faster speed because its trailing portion 40*c* is being driven by the greater can diameter at the open end of the can clamped between the taper 40*c* of roller section 40*b* and the opposed surface 24*e* of axially fixed sleeve 24 inside the can, while at the same time the nose portion of roller section 40*a* which helps to form the nose or flat 41*a* is engaging a smaller diameter of the can being spun as shown in FIG. 2.

Because of the independent and differing speeds of rotation imparted to the two roller sections, wrinkling of the more narrow can end abutting the angular surface of movable member 19 is avoided, particularly in the instance of aluminum containers.

Other anti-friction means may be substituted, and different support means as well.

While a particular arrangement has been shown and described, skilled artisans will appreciate that the design of the drive mechanism, the bearings or bushings (FIG. 2 in particular), the chuck or even the offset eccentric roller assembly can be modified and still be within the scope of the claims which follows. More particularly, the invention herein is the control of the metal forming tools not their particular configuration or structural arrangement.

The material of which these one-piece container bodies are made (one-piece steel or aluminum before the lid is applied) is quite thin as the result of drawing (lengthening the initial thick walled cup-shaped blank) and repeatedly ironing (progressively thinning and lengthening) the drawn body 100, FIG. 3B. The final wall thickness "m" along the major portion of the longitudinal axis (side wall section 101, FIG. 3A) may be 0.003+ inches in the case of steel and 0.004+ inches in the case of aluminum, for example. The bottom wall 102 is not ironed.

The open end or rim portion 103 at "p" has a greater wall thickness, say 0.006+ inches in the case of steel and 0.007+ inches in the case of aluminum. This is due to the ironing process because the excess metal from ironing the side wall accumulates at and thickens the rim portion. The flange for receiving the closure lid is formed from the rim thickness "o" which is typically ⅜ to ½ inch in axial length as shown in FIG. 3A. Structuring the flange will be described in more detail below.

Between the rim and the thinner side wall, there is usually a transition zone 104, FIG. 3A, of variable, tapered thickness "n", thinnest where it meets the side wall diameter and thickest where it meets the rim portion diameter. Typically this transition zone has a length of 7/16 to ½ inch, FIG. 3A.

In any event, by necking the can in the section axially beyond the side wall, commencing with what may be termined the transition diameter 105, FIG. 3A, the diameter of the open end may be considerably reduced thereby saving on the amount of metal for the lid, and there are other attendant advantages as noted above.

The conventional approach (FIG. 3C) to shaping the neck has been to render it arcuate, that is, the neck has a relatively long center of curvature LC from its transition with the side wall to the diameter (D) where the flange is bent outwardly to include the ultimate end edge of the container as will be apparent in FIG. 3C. Thus the conventional necking and flanging operation results in a serpentine cross section, FIG. 3C, and it is this cross section by which further virtues of the present invention may be readily explained.

Sometimes, FIG. 3D, reduction in diameter at the neck is done by a multiple number of dies employed to reduce the diameter in stages, each producing an arcuate bend and imparting a sinusoidal shape. In still another instance an effort is afterwards made to straighten these bends but the result is imperfect due to springback. Indeed, some concavity results and it is not possible to straighten the first bend B1 adjacent the side wall which is critical.

Figure 4:
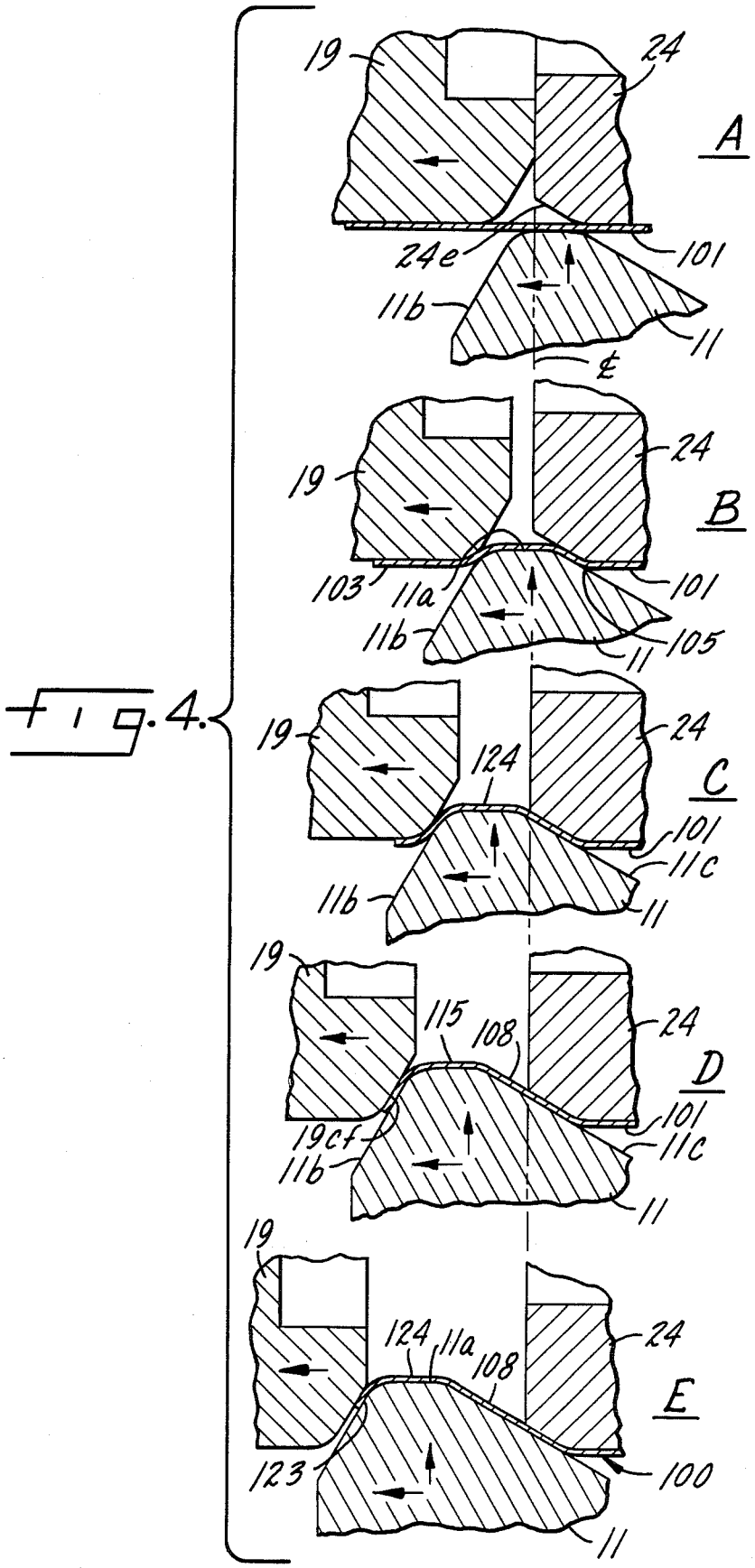

FIG. 4 shows on an enlarged scale progressive formation of the container at its open end in accordance with the present invention. It is to be understood the container body presenting side wall 101 is spinning, along with sleeve 24 and holder 19, FIG. 4.

The side wall of the spinning container body is a straight cylindrical section of generally uniform diameter and thickness, as already noted, extending from the closed bottom wall 102 to a diameter termed herein the transition diameter 105 which is designated in FIG. 4B.

As the external forming roller (11,45) engages the D&I can, FIG. 4A, and commences to penetrate the gap between the fixed internal support sleeve 24 and the axially movable support or holder 19, FIG. 4B, a truncated cone commences to be formed with the transition zone diameter 105 constituting the base of the cone. That is, the base of the container cone and the transition diameter 105 are coincident as is evident in FIGS. 3A and 3B.

The side wall 108 of the cone increases in length (as does the "height" of the cone) as the external die roller chamfer (e.g. the truncated cone chamfer 11*c*, FIG. 1) continues to squeeze or press the container metal along the complemental slope or truncated cone 24*e* of sleeve 24. The cones as 11*c* and 24*e* in the geometric sense are similar and regular so that the truncated cone, which becomes the necked-in portion of the container body, is generated as a true or regular cone 110, FIG. 3B, with an included angle 112 between the base 105 of the cone and the cone side wall 108. The included angle shall not be greater than 60°-62°.

The cone continues to be generated as the external roller (11,45) advances radially inwardly (holder 19 continues to retract axially) until a reduced diameter 115 is achieved, FIG. 3B, constituting the throat diameter D of the container; diameter 115 is also the diameter of the top of the truncated cone. It is here that the throat of the container commences to be formed as will soon be described.

As the cone is being formed, the rim portion 103 of the container body, FIG. 4B, conforms to the lead chamfer of the roller (e.g. 11*b*) and is retracted along the complemental chamfer 19*cf* at the end of holder 19, FIG. 4D, eventually becoming an outwardly bent flange 123 of the container as shown in FIG. 3B.

The container is formed with a short throat 124. The throat 124 is a straight or regular cylinder of uniform diameter D, extending from the throat diameter 115 to the short or inside diameter of the flange 123. Thus, the side wall of the throat 124 is straight, formed by the flat rim 11*a* of the external (die) roller as 11. (It makes no difference whether roller 11 is being used or roller 40, FIG. 2). The throat may have an axial length of about 3/16 inch corresponding to the rim or "flat" (11*a*, 41*a*) of the external forming roller. This flat rim on the roller has small radii at its edges to avoid scratches and sharp bends in the container body. It can be seen in FIG. 4 that the throat 124 is formed concurrently with the cone, while the flange 123 is the last to be formed.

The geometry thus generated results in beam compression forces when a load is applied to the can, not possible with the conventional necked-in structure shown at FIGS. 3C and 3D. Thus when a load F, FIG. 3B, is applied uniformly to the flange of the present container across the throat diameter D, the throat section is entirely in compression. One of the component or resultant forces of this load also places the side wall of the cone section in compression, although the other resultant force does apply a bending moment to the top of the cone 110. However, in the conventional container, FIG. 3C, with the same load F applied uniformly across the throat diameter D (D=D) complex bending moments result without any compressive beam action. Explained another way, the necked-in portion, FIG. 3C, is a weak curved spring, easily flexed and crumpled by an axial load F. It will be readily recognized the same weak features are present when the geometry shown in FIG. 3D is employed, although to a lesser extent when there is an attempt to smooth out the bends shown in FIG. 3D.

The included angle 112 of 60°-62° is critical in several respects. These containers are to be filled with beverages, involving a valved filling nozzle assembly pressed downward against the open end of the container. A container with crush strength up to 300 pounds of axial loading therefore becomes important in this regard, and it is also important from the standpoint of subsequent handling and stacking. Coupled to this is the need to achieve maximum filling capacity and enough room at the throat section for the roller (not shown) which curls or wraps the edge of the lid (not shown) around the perimeter of the flange 123 when the top is hermetrically sealed. During sealing, the can is under compression along its longitudinal axis so that crush strength is again important.

Since the metal, whether steel or aluminum, is necessarily work-hardened during ironing, there is a loss in ductility. This hardening can cause brittle failure (cracking or splitting) at the transition diameter 115 if the included angle 112 of the cone is too small.

An included angle 112 of 60°-62° translates an axial load on the container into an appreciable compression load component on the cone side wall designated $F_T$ in FIG. 3E which in turn has a component $F_B$ tending to buckle the container side wall 101 inward and the magnitude of $F_B$ depends on angle 112 by sine-consine values. Thus, any bending moment on the cone 110 is minimized, and at the same time brittle failure is avoided at the transition diameter during generation of the cone side wall 108.

We claim:

1. A method of spin rolling the open end of a cylindrical container body comprising the steps of positioning inside the container body in axial inwardly spaced relation from the open end thereof an axially fixed sleeve engageable with the inside surface of the container body, said sleeve having a sloped end surface which faces the open end of the container body;

positioning inside the container body a holder which fits the inside diameter of the container body to support the same, said holder having an end facing the sloped end surface of said sleeve, and said holder being supported for axial displacement away from said sleeve, said holder end and said sloped end surface of said sleeve defining a gap therebetween;

positioning opposite said gap on the outside surface of the container body a roller supported for axial displacement away from said sleeve, said roller having a trailing end portion and a peripheral portion;

spinning the container body thus supported by said holder and advancing said roller radially inwardly relative to said gap so that said trailing end portion presented by the roller and said sloped end surface of said sleeve engage the container body between them while said trailing end portion of said roller moves inwardly along said sloped end surface of said sleeve to roll a neck into the container body; and continuing to spin the container body while the roller moves inwardly and the holder retracts axially until the roller has spun an outwardly bent flange on to the end portion of the container body engaged between said holder end and said roller.

2. A method according to claim 1 in which said peripheral portion of said roller comprises a flat rim portion, and including the step of employing said rim portion to roll into the container body a short cylindrical throat between said flange and said container neck.

3. The method of claim 1 wherein said roller further comprises a sloped leading end portion and wherein said holder comprises a sloped end portion facing said sleeve, and including the step of employing said sloped leading end portion of said roller and said sloped end portion of said holder to engage the side wall of the container therebetween during the spin rolling operation.

4. The method of claim 1 wherein said roller comprises a pair of complemental roller sections supported on a mandrel for independent rotation and of which one roller section includes said trailing end portion.

5. A method of spin rolling the open end of a cylindrical container comprising the steps of:

positioning inside the container body in axial inwardly spaced relation from the open end thereof an axially fixed sleeve engageable with the inside surface of the container body, said sleeve having a sloped end surface which faces the open end of the container body;

positioning inside the container body a holder which fits the inside diameter of the container body to support the same, said holder having an end facing said sloped end surface of said sleeve, and said holder being supported for axial displacement away from said sleeve, said holder end and said sloped end surface of said sleeve defining a gap therebetween;

positioning opposite said gap on the outside surface of the container body a roller supported for axial displacement away from said sleeve, said roller having a trailing end portion and a peripheral portion;

spinning the container body thus supported by said holder and advancing said roller radially inward relative to said gap so that said peripheral portion of said roller initially engages the outer side wall of said container substantially at an axial position in line with the end of said gap most distant from the open end of said can so that as said roller moves in a radially inward direction, said sloped end surface of said sleeve cams said roller towards the open end of said container.

6. The method of claim 5 wherein said trailing end portion presented by said roller and said sloped end surface of said sleeve engage the container body between them while said trailing end portion of said roller moves inwardly along said chamfered end surface of said sleeve and axially toward the open end of said container to roll a neck into the container body.

7. The method of claim 5 further comprising the step of continuing to spin the container body while the roller moves radially inwardly and axially toward the open end of said container and the holder retracts axially in a direction away from the bottom of said container until an outwardly bent flange has been rolled on the end portion of the container body engaged between said holder end and said roller.

8. In a method for configuring a sidewall section of a spinning container body having at least one open end, said sidewall section having an innermost extreme relative to said open end of said container body, an improvement comprising the following steps:

squeezing substantially said innermost extreme of said sidewall section of said spinning container body;

configuring said sidewall section of said spinning container body; and squeezing substantially throughout said configuring step at least some portion of said sidewall section that is located at least as inward relative to said open end of said spinning container body as any portion of said sidewall section that is being configured.

9. The method of claim 8 further comprising the following step:

supporting said open end of said container body for driven rotation about the longitudinal axis of said container body.

10. The method of claim 9 further comprising the following step:

providing a means for supporting said open end of said container body for driven rotation about the longitudinal axis of said container body, wherein said means moves in a direction toward the open end of the container body during said configuring step.

11. The method of claim 8 further comprising the following step:

supporting said container body sidewall substantially at said innermost extreme, wherein at the outset of and during said configuring step a portion of said sidewall section that extends from said innermost extreme towards said open end of the container body is forced to primarily move in substantially a pivotal manner relative to and about said innermost extreme.

12. The method of claim 11 further comprising the following step:

providing a means for supporting said container body sidewall substantially at said innermost extreme, wherein said means is fixed axially and radially during said configuring step.

13. The method of claim 12 further comprising the following step:

allowing said means for supporting said container body sidewall substantially at said innermost extreme to rotate freely about its axis.

14. The method of claim 8 further comprising the following step:

supporting an end of said container body opposite to said open end for driven rotation about the longitudinal axis of the container body.

* * * * *